US005171126A

United States Patent [19]

Becker et al.

[11] Patent Number: 5,171,126

[45] Date of Patent: Dec. 15, 1992

[54] CENTRIFUGAL PUMP WITH AN ANNULAR SHROUD

[75] Inventors: Karlheinz Becker, Worms; Karl-Heinz Bayer, Monsheim, both of Fed. Rep. of Germany

[73] Assignee: KSB Aktiengesellschaft, Frankenthal, Fed. Rep. of Germany

[21] Appl. No.: 634,165

[22] PCT Filed: May 30, 1989

[86] PCT No.: PCT/EP89/00604

§ 371 Date: Dec. 13, 1990

§ 102(e) Date: Dec. 13, 1990

[87] PCT Pub. No.: WO89/12755

PCT Pub. Date: Dec. 28, 1989

[30] Foreign Application Priority Data

Jun. 13, 1988 [DE] Fed. Rep. of Germany ..... 3820062

[51] Int. Cl.[5] ..... F03B 11/08

[52] U.S. Cl. ..... 415/121.2; 415/172.1; 415/170.1; 277/47; 277/152; 384/130

[58] Field of Search ..... 415/170.1, 121.2, 121.3, 415/172.1, 106, 169.1; 277/152, 47; 384/130, 144, 477, 624

[56] References Cited

U.S. PATENT DOCUMENTS

| | | | |
|---|---|---|---|
| 2,270,054 | 1/1942 | Hogan | 415/172.1 |
| 2,407,218 | 9/1946 | Beier | 415/172.1 |
| 2,649,050 | 8/1953 | Dibdin . | |
| 2,722,439 | 11/1955 | Brummer . | |
| 2,798,438 | 7/1957 | Greathouse | 415/172.1 |
| 3,213,798 | 10/1965 | Carswell . | |
| 3,677,659 | 7/1972 | Williams | 415/170.1 |
| 3,881,840 | 5/1975 | Bunjes | 415/121.2 |

FOREIGN PATENT DOCUMENTS

| | | | |
|---|---|---|---|
| 0276877 | 8/1988 | European Pat. Off. | 384/477 |
| 815605 | 10/1951 | Fed. Rep. of Germany . | |
| 510831 | 9/1978 | Fed. Rep. of Germany . | |
| 2710913 | 9/1978 | Fed. Rep. of Germany . | |
| 52-69003 | 8/1977 | Japan . | |
| 87/03050 | 5/1987 | PCT Int'l Appl. . | |
| 611186 | 10/1948 | United Kingdom . | |

*Primary Examiner*—Thomas E. Denion
*Attorney, Agent, or Firm*—Peter K. Kontler

[57] ABSTRACT

A centrifugal pump has a housing which defines an annular chamber disposed downstream of the impeller and surrounding the shaft seal. The chamber receives a hollow cylindrical or frustoconical shroud which surrounds the shaft seal with spacing and protects it from solid particles in the conveyed fluid. A non-contact type annular seal between the impeller and the housing surrounds the shroud.

15 Claims, 5 Drawing Sheets

CENTRIFUGAL PUMP WITH AN ANNULAR SHROUD

The invention relates to a fluid flow machine.

In fluid flow machines subjected to the action of a flowing, solids-containing medium, there is the danger of erosion inside the fluid flow machine. Although this can be counteracted by appropriate lining of the housing, a particularly susceptible location nevertheless exists in the region of the shaft seal. The solids contained in the flowing medium, which can have a particle size of up to 1 mm, can destroy the shaft seal itself or the parts of the housing which hold the shaft seal. This can result in premature failure of the fluid flow machine.

OBJECT OF THE INVENTION

It is an object of the invention to provide a means which, in a fluid flow machine subjected to the action of a flowing medium containing solids in the above-mentioned size range, can protect a chamber surrounding the shaft seal, and the shaft seal itself, against erosion.

SUMMARY OF THE INVENTION

The invention is embodied in a fluid flow machine, particularly in a centrifugal pump, which comprises a housing, a shaft member rotatably mounted in the housing, an impeller member on the shaft member, a shaft seal between the shaft member and the housing downstream of the impeller member, and an annular shroud which is disposed in the housing and surrounds at least a portion of the shaft seal with spacing. The shroud has a first end which is carried by the housing and a second end which confronts the impeller member. The second end of the shroud is spaced from the shaft member and/or from the impeller member.

Practical tests with a solids concentration of up to 100 mg per cubic decimeter have surprisingly shown that, with an annular element designed according to the main claim, erosion by solids contained in the flowing medium can be arrested.

In tests with an impeller having a floating ring seal on the side thereof facing the shaft seal, the floating ring seal was damaged within a very short period of time in the absence of the annular element. When, instead, an annular element in accordance with the invention was arranged in the chamber accommodating the shaft seal, no erosion marks were detectable after an extended test period even on the floating ring seal.

BRIEF DESCRIPTION OF THE DRAWING

FIG. 4 shows a non-contact type seal 16 between the impeller 2 and the housing 1. The seal 16 is integral with the shroud 12.

FIG. 5 shows a shroud 12 which has an undercut portion 18 facing away from the impeller 2.

DESCRIPTION OF THE PREFERRED EMBODIMENTS

Figure 1:
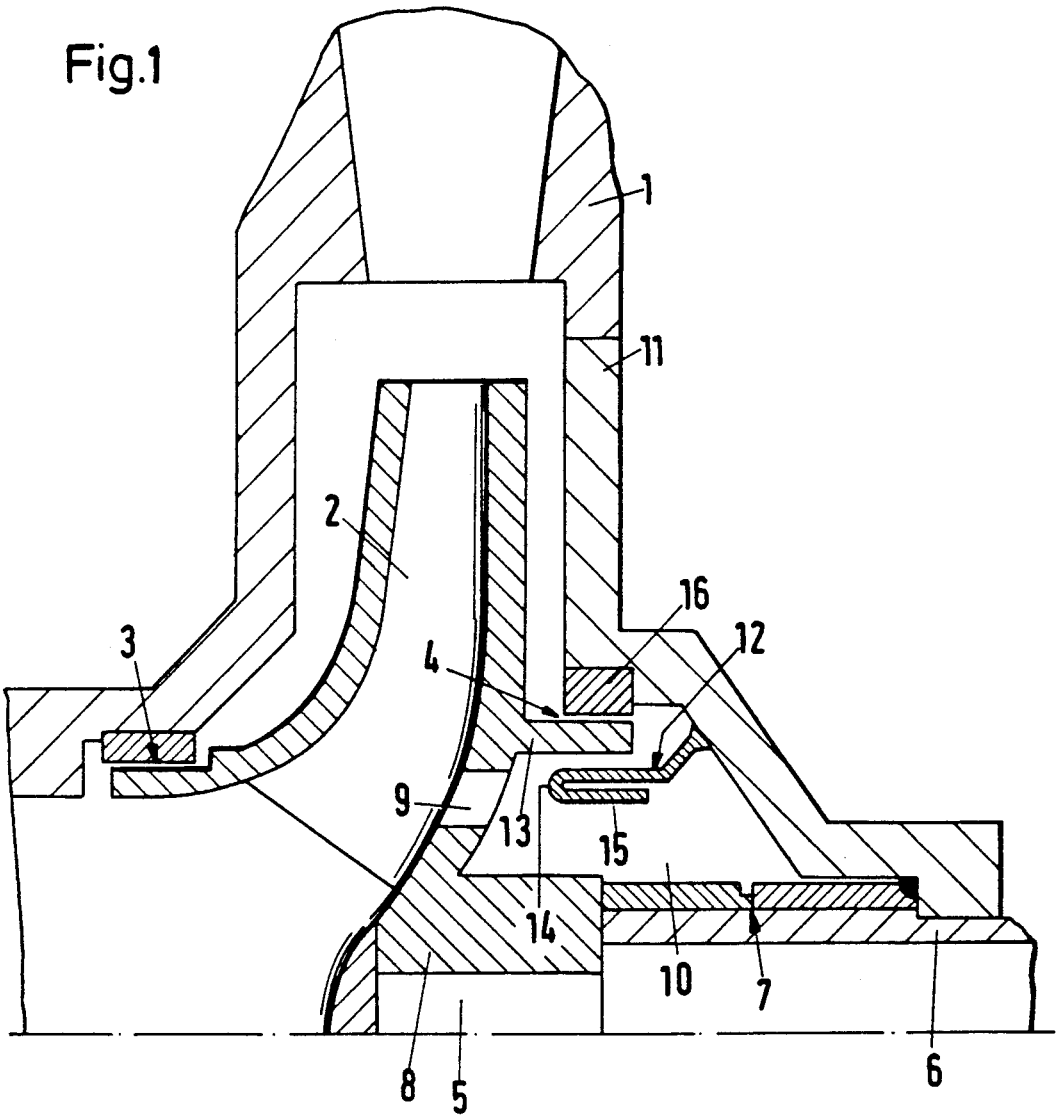
FIGS. 1 to 5 show differently formed annular elements.

FIG. 1 shows a housing 1 of a flow machine, which is here constructed as a centrifugal pump, as well as an impeller 2 inside the housing 1. In the illustrated embodiment, the impeller is equipped with floating ring seals 3,4 on the suction and pressure sides. The impeller 2 is affixed to a shaft 5 as are a protective sleeve 6 for the shaft and a shaft seal in the form of a mechanical seal 7.

Furthermore, in the region of the impeller hub 8, the impeller 2 has bores 9 for the equalization of axial thrust, and the bores 9 are located on the pressure side in the cover disc of the impeller.

An annular element 12 secured to the housing 1, and here to a housing cover 11 on the pressure side, is disposed in the chamber 10 surrounding the shaft seal 7. It extends in the region between the floating ring 13 affixed to the impeller, and the impeller hub 8 and shaft seal 7. The free end face of the annular element 12 has a surface 14 running radially of the shaft, and a tube 15 oriented axially of the shaft seal 7 is applied to the location of the surface 14 at which the diameter of the latter is a minimum. The annular element 12, which is here constructed as a shaped part of sheet material, can also be in the form of a thick shaped part having an undercut on the side thereof facing the shaft seal. Moreover, it can be integral with the floating ring 16 affixed to the housing.

Figure 2:
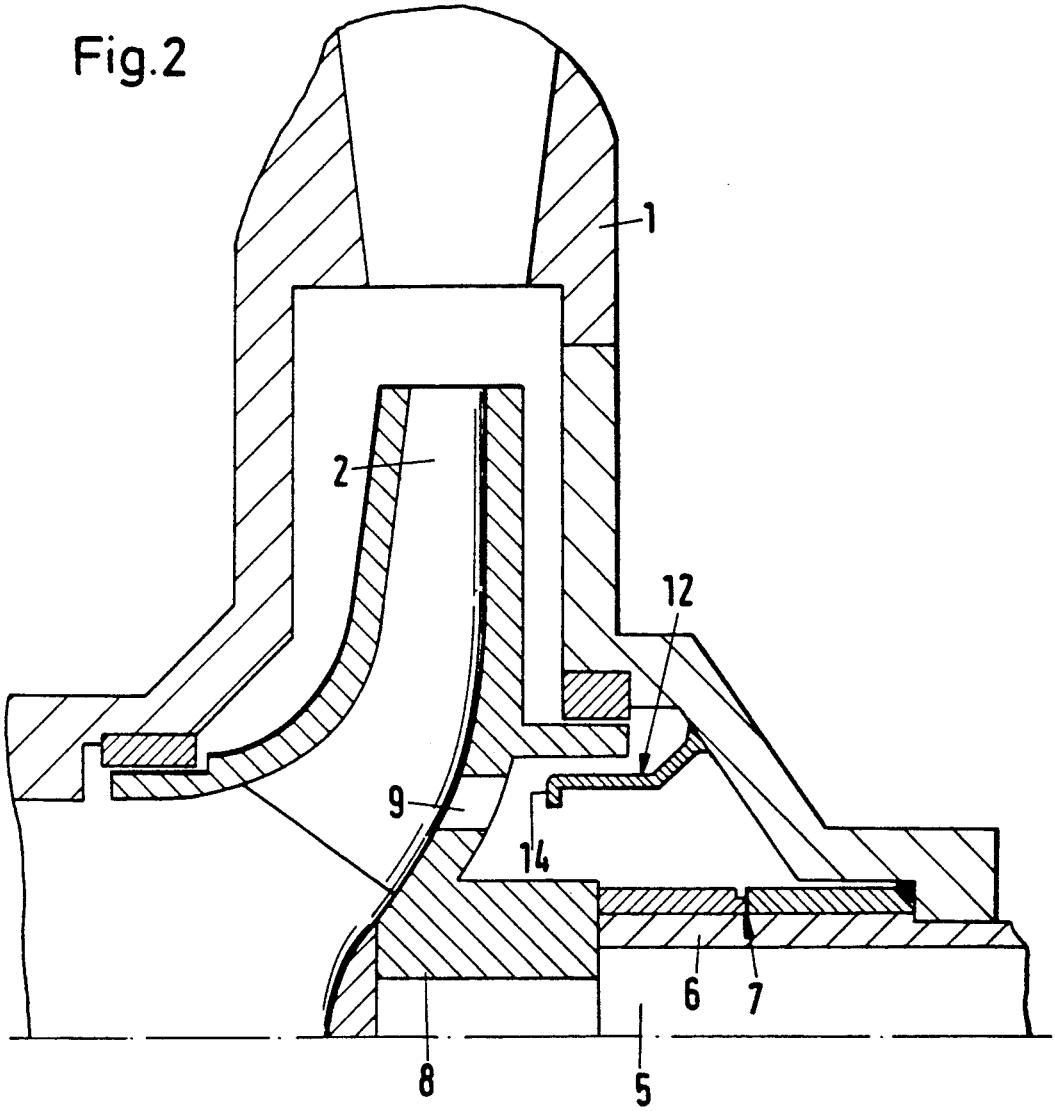

The embodiment of FIG. 2 largely corresponds to that of FIG. 1. A difference is that, at its free end face, the annular element 12 is provided only with a surface 14 running radially of the shaft.

Figure 3:
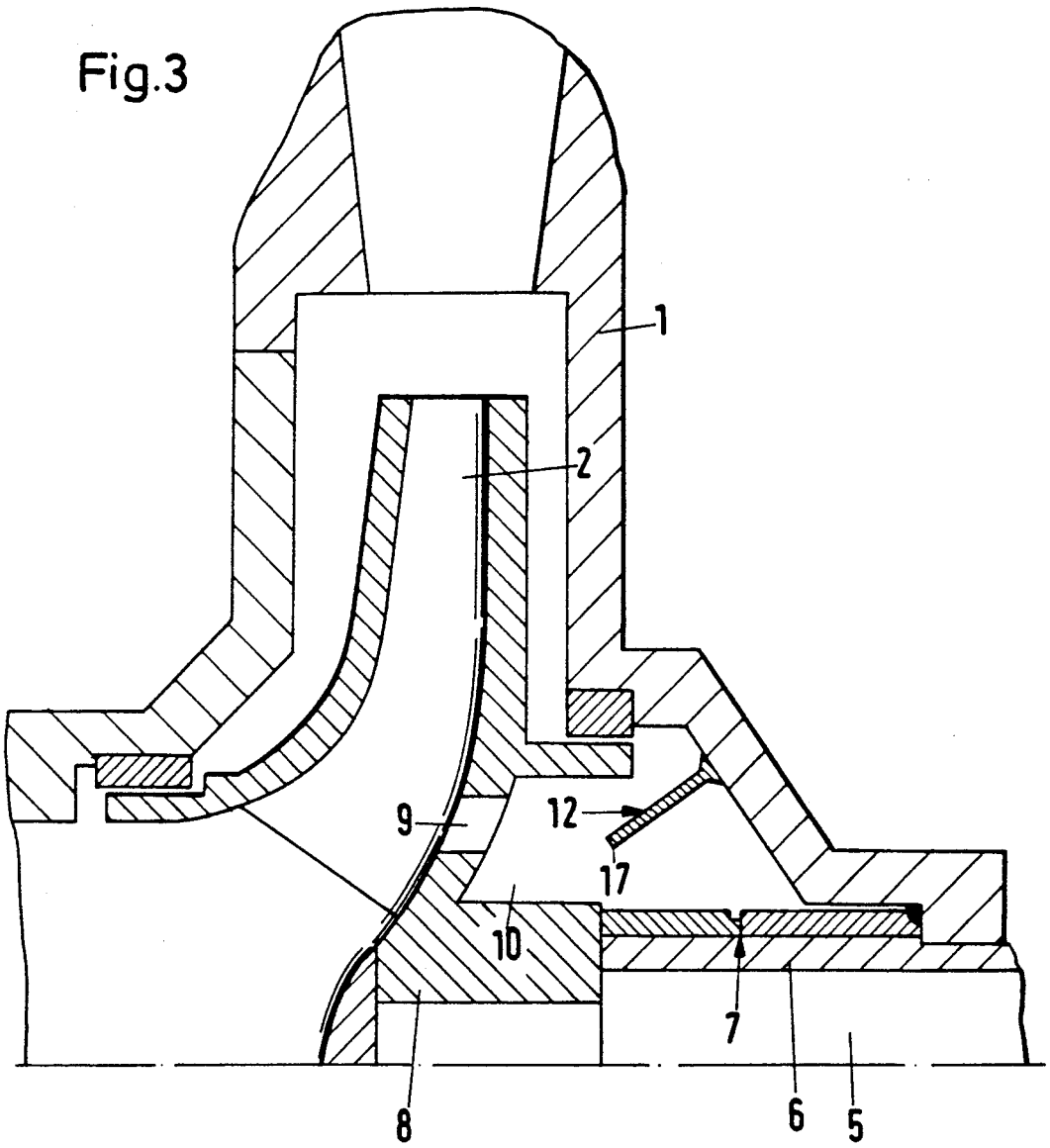
Figure 4:
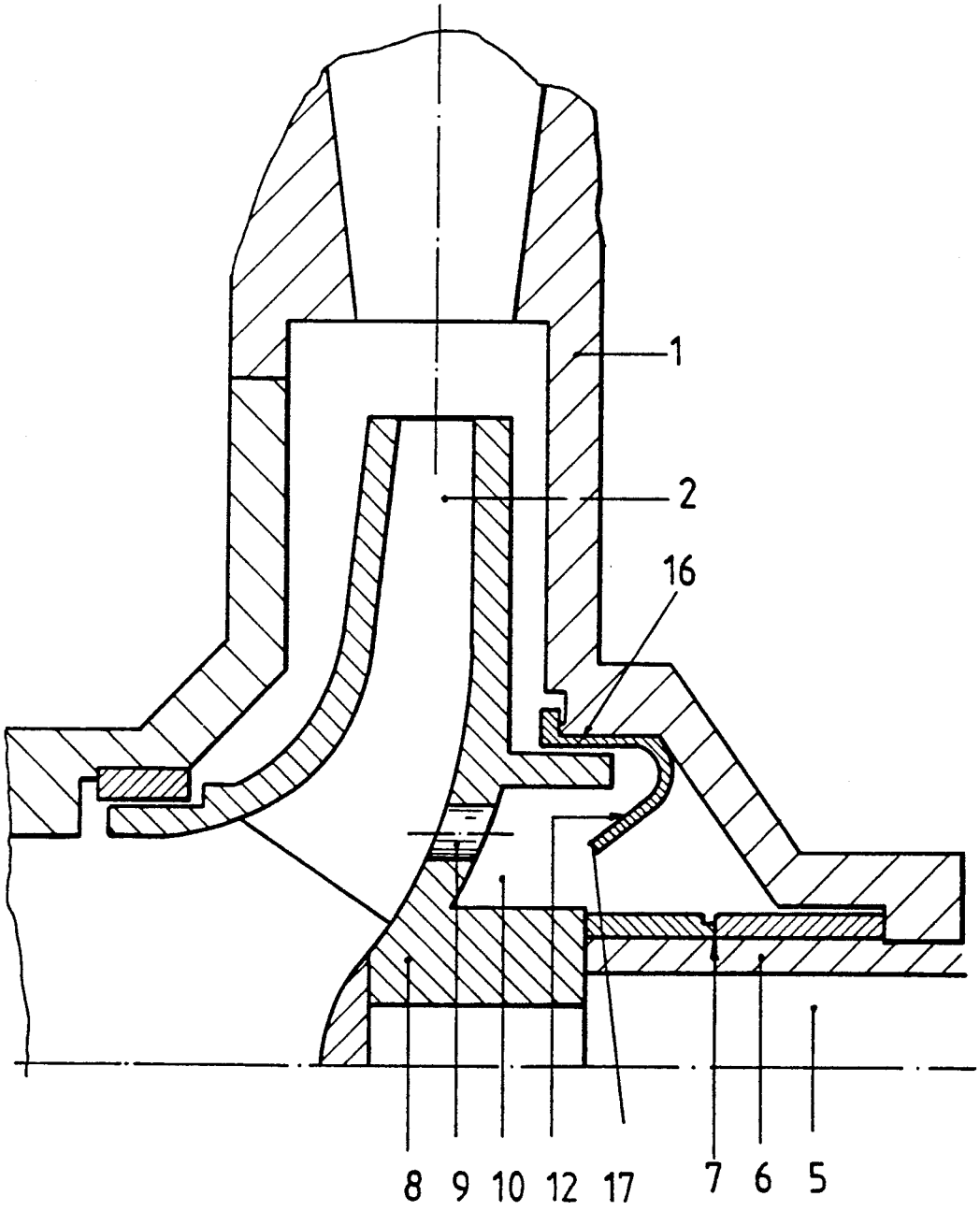
Figure 5:
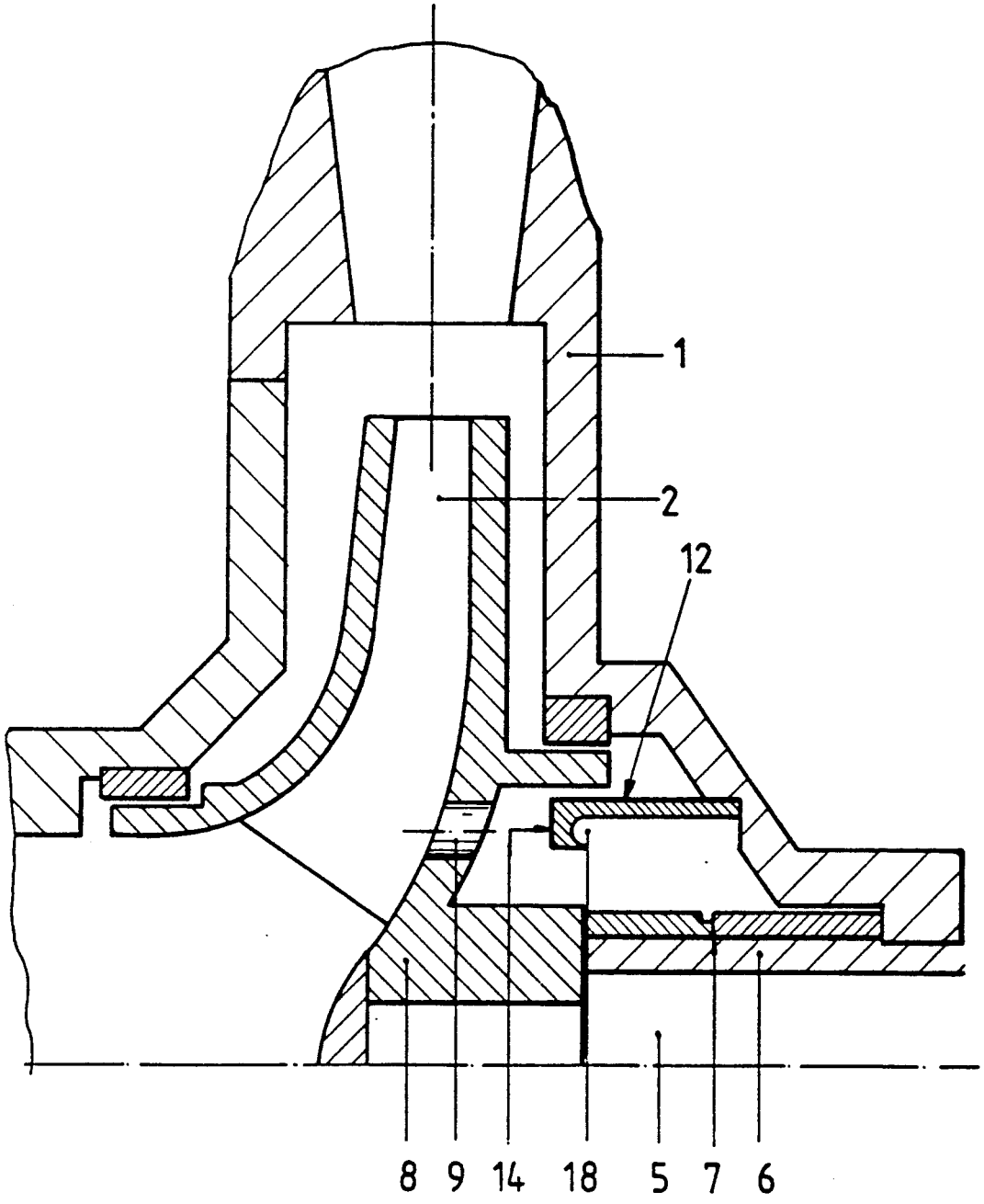

FIG. 3 shows an annular element 12 which is frustoconical in cross section and extends diagonally to the shaft axis with its free end face 17 confronting the shaft 5. Due to the frustoconical design of the annular element 12, an interrupting edge which can prevent erosion inside the chamber 10 exists at the free end face 17 of the annular element 12, as well as at the location of minimum diameter of the surface 14 of the annular element 12 and at a tube affixed to the annular element 12 as shown in FIGS. 1 and 2.

We claim:

1. A fluid flow machine comprising a housing; a shaft member rotatably mounted in said housing; an impeller member on said shaft member; a shaft seal between said shaft member and said housing downstream of said impeller member; and an annular shroud disposed in said housing, surrounding at least a portion of said shaft seal with spacing and surrounded by said housing with spacing, said shroud having a first end carried by said housing and a second end confronting said impeller member, said second end being spaced from at least one of said members.

2. The machine of claim 1, wherein said shaft seal is a mechanical seal.

3. The machine of claim 1, wherein said impeller member has a hub surrounding said shaft member and the second end of said shroud is spaced from said impeller member.

4. The machine of claim 1, wherein at least a portion of said shroud between said first and second ends thereof is a hollow cylinder.

5. The machine of claim 1, wherein at least a portion of said shroud between said first and second ends thereof is a hollow conical frustum.

6. The machine of claim 1, further comprising a non-contact type annular seal between said impeller member and said housing, said annular seal surrounding said shroud in the region of said second end with spacing.

7. The machine of claim 1, wherein said impeller member has an annulus of thrust equalizing channels adjacent to the second end of said should, the diameter of said annular of channels at least approximating the diameter of said shroud at the second end thereof.

8. The machine of claim 1, wherein said shroud is a hollow conical frustum.

9. The machine of claim 8, wherein said should has a surface located at said second end thereof and extending substantially radially of said shaft member.

10. The machine of claim 1, wherein said shroud includes a cylindrical portion between said ends thereof and has a surface disposed at said second end and extending substantially radially of said shaft member, said cylindrical portion being substantially coaxial with said shaft member.

11. The machine of claim 1, further comprising a non-contact type annular seal between said impeller member and said housing, said annular seal having a first ring on said housing, a second ring on said impeller member and a gap of predetermined width between said rings, said shroud having a substantially cylindrical portion between said first and second ends, and said cylindrical portion being spaced from said annular seal by a distance which is a multiple of said predetermined width.

12. The machine of claim 1, wherein said shroud includes a first portion between said first and second ends, an annular surface disposed at said second end and having a surface portion nearest to said shaft member, and a tubular second portion rigid with said first portion at said surface portion and extending from said second end towards said first end.

13. The machine of claim 1, further comprising a non-contact type angular seal between said impeller member and said housing, said annular seal having a ring which is integral with said shroud.

14. The machine of claim 1, wherein at least a portion of said shroud consists of metallic sheet material.

15. The machine of claim 1, wherein said shroud has an undercut portion facing away from said impeller member.

* * * * *